United States Patent [19]

Barrera

[11] Patent Number: 4,790,578

[45] Date of Patent: Dec. 13, 1988

[54] DROP ROD LATCH FOR DOUBLE-HUNG GATES

[76] Inventor: Raymundo M. Barrera, 2219 Ash St., Laredo, Tex. 78040

[21] Appl. No.: 776,890

[22] Filed: Sep. 17, 1985

[51] Int. Cl.[4] ..... E05B 67/00; E05C 5/02

[52] U.S. Cl. ..... 292/148; 292/57; 292/205; 49/394

[58] Field of Search ..... 292/57, 58, 59, 60, 292/61, 183, 189, 205, 5, 148, 213; 49/394

[56] References Cited

U.S. PATENT DOCUMENTS

| | | | |
|---|---|---|---|
| 727,494 | 5/1903 | Thompson | 292/148 |
| 854,193 | 5/1907 | Betts | 292/189 |
| 988,455 | 4/1911 | Gee | 292/189 |
| 1,024,705 | 4/1912 | Sprague et al. | 292/213 |
| 1,355,371 | 10/1920 | Welsh | 292/57 |
| 1,740,301 | 12/1929 | Heyman | 292/57 |
| 1,862,672 | 6/1932 | Fleming | 292/5 |
| 2,940,790 | 6/1960 | Ingalls et al. | 292/189 |
| 3,174,314 | 3/1965 | Johnson | 292/57 |
| 3,451,703 | 6/1969 | Roegner | 292/148 |
| 3,752,518 | 8/1973 | Cannell | 292/148 |
| 4,178,024 | 12/1979 | Wagner | 292/57 |
| 4,512,105 | 4/1985 | Norton | 292/57 |

FOREIGN PATENT DOCUMENTS

| | | | |
|---|---|---|---|
| 159111 | 6/1957 | Sweden | 292/148 |
| 413085 | 7/1934 | United Kingdom | 292/148 |

*Primary Examiner*—Michael Safavi

*Attorney, Agent, or Firm*—Channing L. Pace

[57] ABSTRACT

An improved drop rod latch for use with double-hung gates used with fences of woven wire fabric. Typically one of such gates is secured in position by a vertically reciprocating latch rod carried in tubular guides attached to the inside or central stile of the gate frame and engaging at its lower end a hole or a socket member placed in the ground. The upper end of this latch rod has a short, right-angled extension which serves as a handle by which the latch may be grasped for manipulation. The central stile of the other gate frame carries a fork latch pivoted to extend between a horizontally projecting position in which it embraces the central stile of the gate to which the latch rod is attached and a vertically projecting position in which it does not engage said gate. Thus, when the latch rod is in engagement with the ground socket and the fork latch is embracing the latch rod-carrying stile, the gates cannot be swung to open position. The fork latch can be secured in horizontally projecting position by a conventional padlock. The improvement includes one or more projections on the latch rod which prevent its removal from the gate which carries it.

10 Claims, 2 Drawing Sheets

DROP ROD LATCH FOR DOUBLE-HUNG GATES

BACKGROUND OF THE INVENTION

In a conventional installation an opening is left in the fence in which double-hung gates are mounted. The fence terminates at the opening with a post on each side of the opening. A gate is pivotally mounted on each of the terminal posts. The gates are similar in configuration and are usually mirror images of each other. Where they meet at the center of the opening they are provided with means to hold them in fixed position against opening.

This means includes a vertically reciprocating latch rod mounted in two vertically spaced tubular guide members attached to the central stile of one of the gates which we will call the first gate. The lower end of this latch rod is intended to fit in a hole or in a socket member mounted in the ground and to hold the gate against swinging movement. The upper end of this latch rod has a right-angled extension which serves as an operating handle for the latch rod. This extension can be an integral bend in the rod or a separate cross member welded to the end of the latch rod. The central stile of the other gate, which we will call the second gate, carries a fork latch member pivoted to the central stile and movable between a horizontally projecting position in which it embraces the central stile of the first gate and a vertically projecting position in which it is free of said first gate. This fork latch member can be secured in its horizontally projecting position by a padlock.

One objection to the above-described latching system is that the vertically reciprocating latch rod can be raised far enough to be disengaged from the lower of the tubular guide members. Indeed, there is nothing to prevent its being manipulated at its upper end around the padlock so that it can be raised past the upper tubular guide member and removed completely from its operating position in the gate. Eventually the latch rod is left lying on the ground where it can be run over by a car and bent out of shape and ultimately lost. Moreover, with the latch rod out of its ground-mounted socket it is possible for both gates to swing open even with the padlock in position.

SUMMARY OF THE INVENTION

In light of the objections to the type of double-hung gate latching arrangement described above, it is a primary object of this invention to provide means whereby the vertically reciprocating latch rod used on a double-hung gate can be prevented from being raised above the level of the lower tubular guide member.

It is a further object of this invention to provide a lateral projection, also called a "stop stud" on the vertical latch rod below the level of one of the tubular guides which will engage the guide when the latch rod is raised and prevent its being removed from the lower guide.

It is a still further object of the invention to provide the handle end of the latch rod with a stop stud extending in a direction opposite to the handle extension for engaging the padlock when it is in place. This is to be called the "upper stop stud".

It is a further object of this invention to provide the extension on the upper end of the latch rod with an upturned end.

It is another object of this invention to provide the extension on the upper end of the latch rod with a 90° downturned end.

It is a further object of this invention to form the lower stop stud as a welded extension placed intermediate the ends of the latch rod.

It is a further object of this invention to make the latch rod tubular guides vertically adjustable on the gate stile.

It is another object of this invention to form the latch rod as a single piece of rod stock with the handle and upper and lower stop studs formed as "bends" or "extrusions" of the rod.

It is a final object of this invention to provide a latch rod of a double-hung gate assembly which will be foolproof and fail safe.

These together with other objects and advantages which will become subsequently apparent reside in the details of construction and operation as more fully hereinafter described and claimed, reference being had to the accompanying drawings forming a part hereof, wherein like numerals refer to like parts throughout the description.

DETAILED DESCRIPTION OF THE DRAWINGS

DETAILED DESCRIPTION OF THE INVENTION

Figure 1:
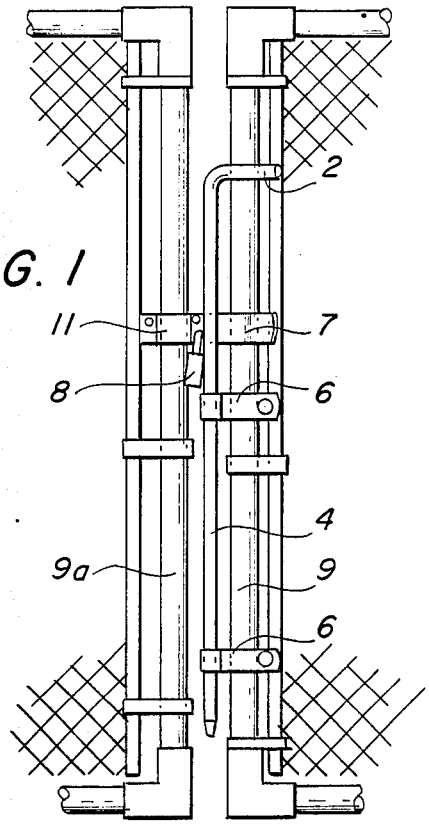
FIG. 1 is a side elevational view of the latching ends of double-hung gates in a fence opening showing a conventional "L" shaped latching rod without stop studs and shown slipping right past the padlocked fork latch.
Figure 2:
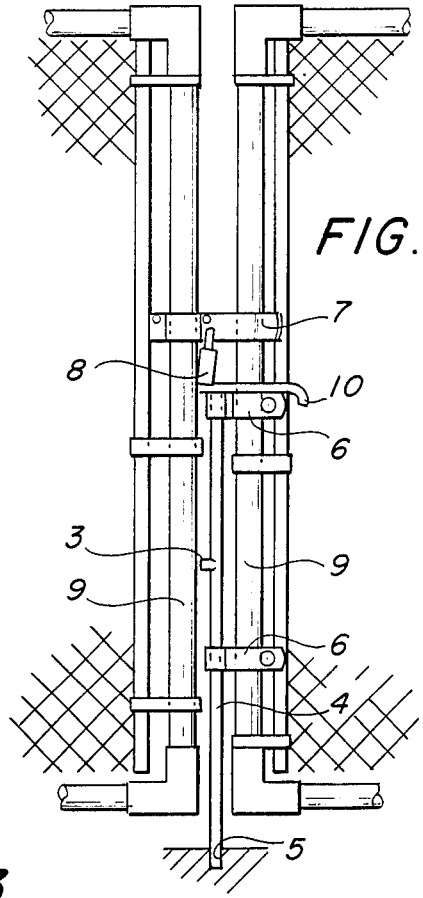
FIG. 2 is a side elevational view of the latching ends of double-hung gates in a fence opening showing the lower stop stud above the lower tubular guide.

Referring now more specifically to the drawing, FIG. 1 shows adjacent sides of two double-hung gates in latched position. Each gate is composed of a tubular frame including an outer vertical stile (not shown) on which are mounted the hinges which hingedly support the gate in the fence opening. At the opposite side of each gate is an inner stile 9 on which the latching means for the gates are mounted. The latching means include primarily a vertically reciprocating latching rod 4 mounted on the inner stile 9 of one of the gates by means of upper and lower retaining guide fittings 6,6. Latching rod 4 has at its upper end a right-angularly extending handle member 2 which is normally positioned inside the fenced-in area and by which the latching rod can be manipulated. The lower end of latching rod 4 is arranged to fit into an opening or a socket member 5 mounted in the ground beneath the adjacent edges of the two gates. When the lower end of the latching rod 4 is positioned in the ground socket member 5, the gate which carries this latching rod is held against swinging movement. The stile 9*a* of the other gate carries a clamping collar 11 which supports a pivoted fork latch 7. This fork latch pivots on collar 11 between a horizontally extending position in which it embraces the stile 9 of the latched gate and a vertically extending position which is free of stile 9 and permits the gate to swing open. The fork latch 7 is secured in the horizontal position by a padlock 8. The latching rod 4 can then be elevated out of socket 5 to permit the other gate to swing open.

In an installation such as that shown in FIG. 1 it is possible to elevate the latching rod 4 out of the ground socket 5 even when padlock 8 is in securing position. When this happens, the formerly latched gate is free to swing open and carry the other gate with it until stile 9 slides out from between the arms of fork latch 7. In addition to this the latching rod 4 can be completely removed from retaining guide fittings 6,6.

To prevent the above-described situation from occurring, I have devised the improvement which constitutes my invention. I have provided an abutment or lower stop stud 3 on the latching rod 4 in such a position that it will engage either or both of the retaining guide fittings after the rod has been removed from ground socket member 5 but before it can be removed from either of the retaining guide fittings 6.

Figure 3:
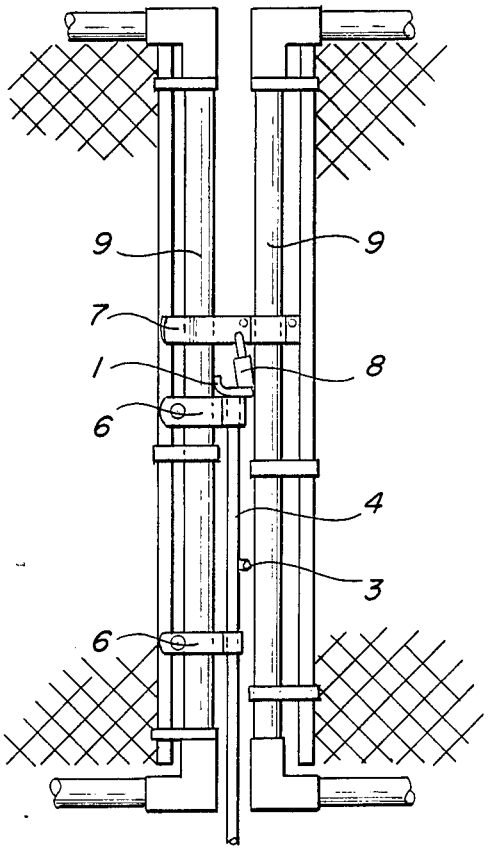
FIG. 3 is a side elevational view similar to FIG. 1 but showing stop stud below the upper tubular guide.
Figure 4:
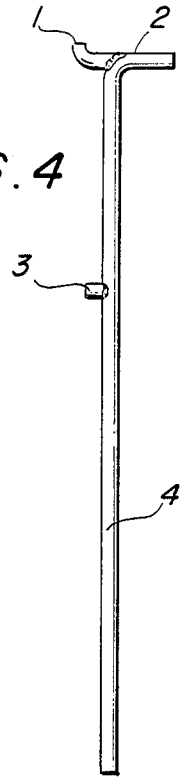
FIG. 4 is a side elevational view of the latching rod having the upper stop stud welded to the bend forming the handle.

The lower stop stud 3 can be in the form of a short section of rod stock similar to that of the latching rod 4 welded as shown in FIGS. 3 and 4 to an intermediate portion of the latching rod 4 in such a position as to engage one or the other or both of the retaining guide fittings 6.

Figure 6:
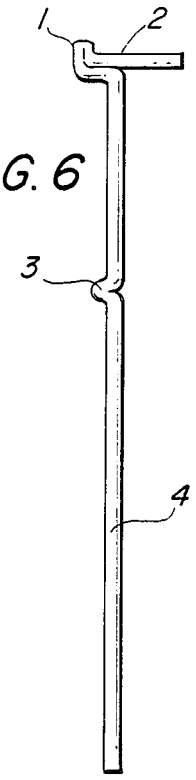
FIG. 6 is a side elevational view of a latching rod having an extruded bend forming the lower stop stud and a double extruded bend forming the upper stop stud and the handle.
Figure 7:
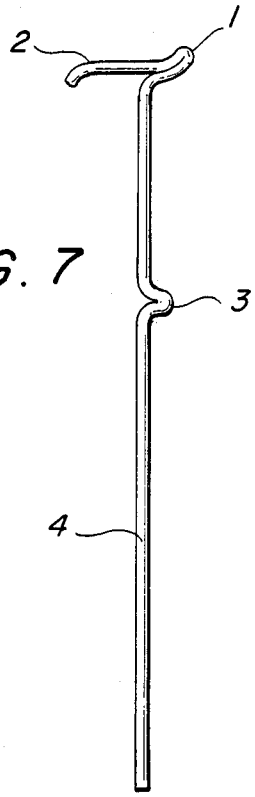
FIG. 7 is another form of latching rod having extruded bends for the lower stop stud and for the upper stop stud and handle.

As an alternative arrangement the lower stop stud can be formed as an extrusion or by bending the rod sharply back upon itself as shown in FIGS. 6 and 7.

To prevent the elevation of the latching rod 4 from the socket member 5 while padlock 8 is in its fork-latch-securing position I have provided an upper stop stud 1. This upper stop stud 1 is an extension of handle member 2 extending in a direction opposite to the handle member 2 so that it can engage fork-latch 7 and padlock 8 when any attempt is made to raise the latching rod 4 out of the ground socket 5 to permit the gates to swing open even when the padlock 8 is in place.

Figure 5:
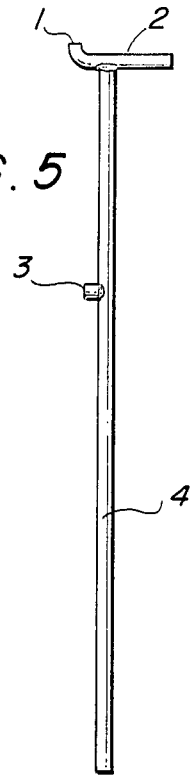
FIG. 5 is a side elevational view of the latching rod having a separate handle member welded to the upper end of the latching rod.

The upper stop stud and handle member 2 combination can take several different forms as shown in the drawing. For instance it can be a short section of rod having a slightly upturned end and welded to the bend which forms the handle 2 as seen in FIG. 4. Instead of being formed as a bent extension of the upper end of latching rod 4, the handle member 2 can be formed as a short section of rod stock having an upturned end and welded directly to the upper end of the latch rod as shown in FIG. 5.

As another alternative, the upper end of latching rod 4 can be formed with a double "extruded" bend with an outwardly and upwardly extending stop stud and an inwardly extending straight handle portion as seen in FIG. 6.

Another form of an upper stop stud and handle combination is shown in FIG. 7 wherein the handle has a 90° downturned portion on one end and an upwardly extruded bend on the other end forming an upper stop stud 1. Lower stop stud 3 is also an extruded bend.

Figure 8:
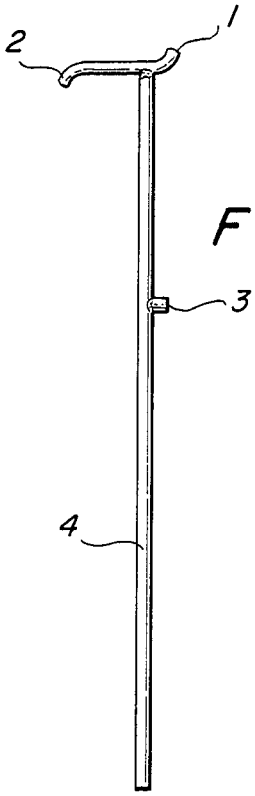
FIG. 8 is a side elevational view of another form of latching rod having a welded lower stop stud and a welded handle and upper stop stud.

FIG. 8 shows an arrangement similar to FIG. 7 but having a rod section having one end downturned 90° and the other end upturned 90°. This rod section is welded to the upper end of latching rod 4 which has a welded lower stop stud 3.

It can thus be seen that I have fulfilled the objects of my invention by providing an improved, simple and economical latching device in a very practical and simple way which can readily be adapted for use with any of the double-hung gates, particularly those having a tubular frame covered with any type of wire fabric.

The many features of my invention are:

a. It is simple in design.
b. It is inexpensive to manufacture.
c. It is relatively easy to operate.
d. It provides a very simple latching apparatus.
f. It can easily be padlocked from either side of the closed gate.
g. It can be operated with ease from either side of the closed gate.
h. It eliminates the need of having to wrap a piece of chain with a padlock around the stiles of the gate.
i. It prevents removal of the latching rod from its latched position until the padlock is removed.
j. The features can be adapted for use on latching rods of different lengths.
k. It can be manufactured in different ways to accomplish the same result.
l. The upper stop stud also prevents the handle portion from pivoting to the outside of the fenced-in area.

Having thus fully described my invention and the manner in which its objects may be carried out, what I claim as new and desire to secure by Letters Patent is as follows:

1. In a double-hung gate assembly wherein each gate has a stile closely adjacent to a stile on the other gate, means latching rod mounting a for vertical reciprocation on a first stile to engage at said rod's lower end a ground-mounted socket and having a handle projecting laterally of said rod's upper end, a fork latch mounted on the other stile to pivot between a horizontal position in which the fork latch embraces said first stile and a vertical position in which said fork latch is free of said first stile means including a padlock for retaining said fork latch in said horizontal position, the improvement comprising an abutment member on said latching rod to engage the latching rod mounting means after said latching rod is moved clear of said ground mounted socket.

2. The improvement as set forth in claim 1 wherein the latching rod mounting means includes upper and lower tubular guide members attached to said first stile and slidably carrying said latching rod and wherein the abutment member is a stop stud which engages a tubular guide member after said latching rod is moved clear of said ground mounted socket.

3. The improvement as set forth in claim 2 wherein the latching rod mounting means includes upper and lower tubular guide members attached to said first stile and slidably carrying said latching rod and wherein the stop stud engages the upper tubular guide member after said latching rod is moved clear of said ground mounted socket.

4. The improvement as set forth in claim 3 wherein the stop stud is a section of rod stock welded to the latching rod.

5. The improvement as set forth in claim 2 wherein the stop stud is a bend or extrusion of the latching rod.

6. The improvement as set forth in claim 1 wherein the handle is a separate member welded to the upper end of the latching rod.

7. The improvement as set forth in claim 6 wherein the handle has a main handle portion extending in one direction and a short extension projecting in the opposite direction and engaging said padlock to limit upward movement of said latching rod.

8. The improvement as set forth in claim 7 wherein the handle portion has one end downturned and the other end upturned.

9. The improvement as set forth in claim 1 wherein the latching rod has an extruded bend forming the lower stop stud and a double extruded bend forming both the upper stop stud and the handle.

10. The improvement in claim 9 wherein the double extruded bend is upturned to form the upper stop stud.

* * * * *